US012760497B2

(12) United States Patent
Oyama

(10) Patent No.: US 12,760,497 B2
(45) Date of Patent: Oct. 13, 2026

(54) WORKING VEHICLE

(71) Applicant: TAKEUCHI MFG. CO., LTD., Hanishina-gun (JP)

(72) Inventor: Hidaka Oyama, Hanishina-gun (JP)

(73) Assignee: TAKEUCHI MFG. CO., LTD., Hanishina-gun (JP)

( * ) Notice: Subject to any disclaimer, the term of this patent is extended or adjusted under 35 U.S.C. 154(b) by 465 days.

(21) Appl. No.: 18/223,113

(22) Filed: Jul. 18, 2023

(65) Prior Publication Data

US 2024/0287758 A1 Aug. 29, 2024

(30) Foreign Application Priority Data

Feb. 27, 2023 (JP) ..... 2023-027878

(51) Int. Cl.
*E02F 9/08* (2006.01)

(52) U.S. Cl.
CPC ..... *E02F 9/0866* (2013.01); *E02F 9/0858* (2013.01)

(58) Field of Classification Search
CPC ..... E02F 9/0858; E02F 9/0866
See application file for complete search history.

(56) References Cited

U.S. PATENT DOCUMENTS

2009/0199553 A1* 8/2009 Nishimura et al. ... E02F 9/2292 60/486

FOREIGN PATENT DOCUMENTS

| | | | | |
|---|---|---|---|---|
| JP | 5054851 B2 | 10/2012 | | |
| JP | 5185082 B2 | 4/2013 | | |
| JP | 7182748 B2 | 12/2022 | | |
| KR | 20-2021-0002124 U | 9/2021 | | |
| WO | WO-2011102042 A1 * | 8/2011 | ..... | B60K 11/08 |
| WO | WO-2015019715 A1 * | 2/2015 | ..... | B60K 1/04 |
| WO | 2023/007981 A1 | 2/2023 | | |

OTHER PUBLICATIONS

Naito, Makoto, "Working Vehicle" (WO-2015019715-A1), machine translation. (Year: 2015).*
Yunoue et al., "Electrical Construction Machine" (WO-2011102042-A1), machine translation. (Year: 2011).*
Office Action dated Jun. 17, 2025, issued in counterpart JP Application No. 2023-027878, with English translation. (6 pages).
Extended European Search Report dated Jul. 24, 2024, issued in counterpart Application No. 23186364.8. (7 pages).

* cited by examiner

*Primary Examiner* — Tara Mayo
(74) *Attorney, Agent, or Firm* — WHDA, LLP

(57) ABSTRACT

A working vehicle includes a first device chamber and a second device chamber in front and rear portions of a vehicle body and a first partition and a second partition partitioning the first device chamber and the second device chamber from surroundings inside the vehicle body, the first device chamber includes devices, e.g., a hydraulic pump, an electric motor, and an inverter, generating heat and becoming relatively high temperature or having relatively high heat resistance, the second device chamber includes devices, e.g., an on-board charger, a battery pack, a converter, and a controller, generating heat and not becoming relatively high temperature or having relatively low heat resistance, and the first device chamber and the second device chamber are separately cooled by cooling fans.

4 Claims, 6 Drawing Sheets

WORKING VEHICLE

CROSS-REFERENCE TO RELATED APPLICATION

This application is based upon and claims the benefit of priority of the prior Japanese Patent Application No. P2023-027878, filed on Feb. 27, 2023, and the entire contents of which are incorporated herein by reference.

TECHNICAL FIELD

The present invention relates to a working vehicle including a working unit working by a hydraulic pressure, an electric motor that is a drive source for the working unit, and a battery pack that supplies electric power to the electric motor.

BACKGROUND ART

As an example of a working vehicle, a hydraulic excavator, a track loader, and the like including a lower body to which driving crawlers or tires are mounted, an upper body provided on the lower body, and a working unit that is mounted to the lower body or the upper body and that works by a hydraulic pressure are known.

Recently, a working vehicle driven by an electric motor instead of a conventional engine is under development. In the electrification of the working vehicle, it is important to thermally control on-board devices (refer to PTL: Japanese Patent No. 7182748).

SUMMARY OF INVENTION

Technical Problem

In the working vehicle described above as an example, improved cooling efficiency is attained by partitioning a vehicle body interior into an electrical device chamber where electrical devices are accommodated and a hydraulic device chamber where hydraulic devices are accommodated, and separately providing a cooling system dedicated to cool the electrical devices and a cooling system dedicated to cool the hydraulic devices. As for device cooling, it is necessary to actuate the cooling system at a reference temperature matched to the device with the lowest heat resistance in each device chamber. However, with mere categorization into the electrical devices and the hydraulic devices, a proper temperature zone wildly fluctuates among the devices, resulting in difficulty in controlling the cooling systems and failure to achieve efficient cooling. As a result, availability factors of the cooling systems tend to rise, leading to an increase in power consumption and the generation of noise from the cooling systems (such as fans).

Solution to Problem

The present invention has been accomplished under the solutions as disclosed below. An object of the present invention is to provide a working vehicle capable of improving cooling efficiency and achieving reduced power consumption and suppressed noise.

The present invention solves the problems by the following solutions.

A working vehicle having a vehicle body, a travel unit, a working unit working by a hydraulic pressure, and an electric motor that serves as a drive source for the travel unit or the working unit, includes: a first device chamber provided in a front portion of the vehicle body; a second device chamber provided in a rear portion of the vehicle body; a first partition that partitions the first device chamber from surroundings inside the vehicle body; and a second partition that partitions the second device chamber from the surroundings inside the vehicle body, the first device chamber including devices that generate heat and that become relatively high temperature or have relatively high heat resistance, the device including a hydraulic pump that supplies hydraulic oil to the travel unit or the working unit; an electric motor that drives the hydraulic pump; and an inverter that controls a driving voltage of the electric motor, the second device chamber including devices that generate heat and that do not become relatively high temperature or have relatively low heat resistance, the device including an on-board charger that supplies electric power for driving the electric motor; a battery pack having a rechargeable battery that stores the electric power supplied from the on-board charger; a converter that converts an output voltage of the battery pack; and a controller, and the first device chamber and the second device chamber being cooled by separate cooling fans, respectively.

According to the configurations, ranges of the proper temperature zones of the devices provided in the device chambers can be reduced, facilitating the management of the reference temperatures (that is, cooling fan control). Therefore, improved cooling efficiency, reduced power consumption, and suppressed noise caused by the cooling fans can be achieved. Furthermore, isolating the first device chamber and the second device chamber by the partitions can prevent heat generated in the first device chamber from being transferred to the second device chamber. Therefore, it is possible to prevent heat damage to devices with low heat resistance.

It is also preferable that the first device chamber has a first air inlet in the front portion of the vehicle body and a first air outlet in one side portion of the vehicle body.

It is also preferable that the second device chamber has a second air inlet in the other side portion of the vehicle body and a second air outlet in the one side portion of the vehicle body, and includes a third partition that partitions the on-board charger disposed at a position closer to the second air inlet from the battery pack disposed at a position farther from the second air inlet.

Furthermore, it is preferable that the vehicle body includes a counterweight that is provided in the rear portion and that maintains a balance during slewing, that the counterweight has a third air inlet at a position closer to the second air inlet, and that the battery pack is cooled by outside air taken in mainly from the third air inlet.

Moreover, it is preferable that the second device chamber includes an oil cooler proximate to the second air outlet, that the counterweight has a fourth air inlet at a position closer to the second air outlet, and that the oil cooler is cooled by the outside air taken in from the second air inlet, the third air inlet, and the fourth air inlet.

Advantageous Effects of Invention

According to the present invention, it is possible to improve the cooling efficiency of the working vehicle. Therefore, it is possible to realize the reduced power consumption and the suppressed noise.

DESCRIPTION OF EMBODIMENTS

Figure 1:
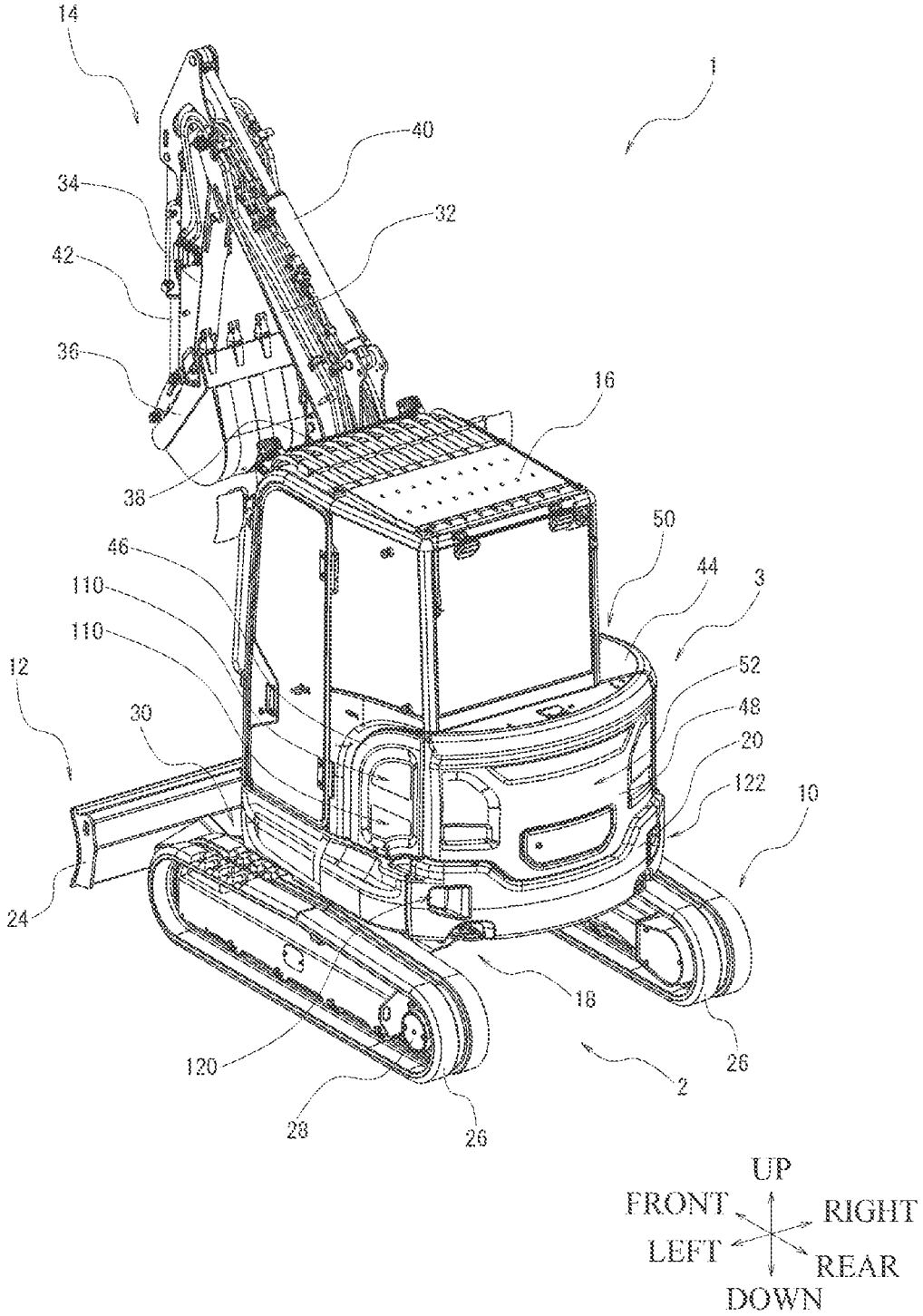
FIG. 1 is a perspective view illustrating an example of a working vehicle according to an embodiment of the present invention.
Figure 2:
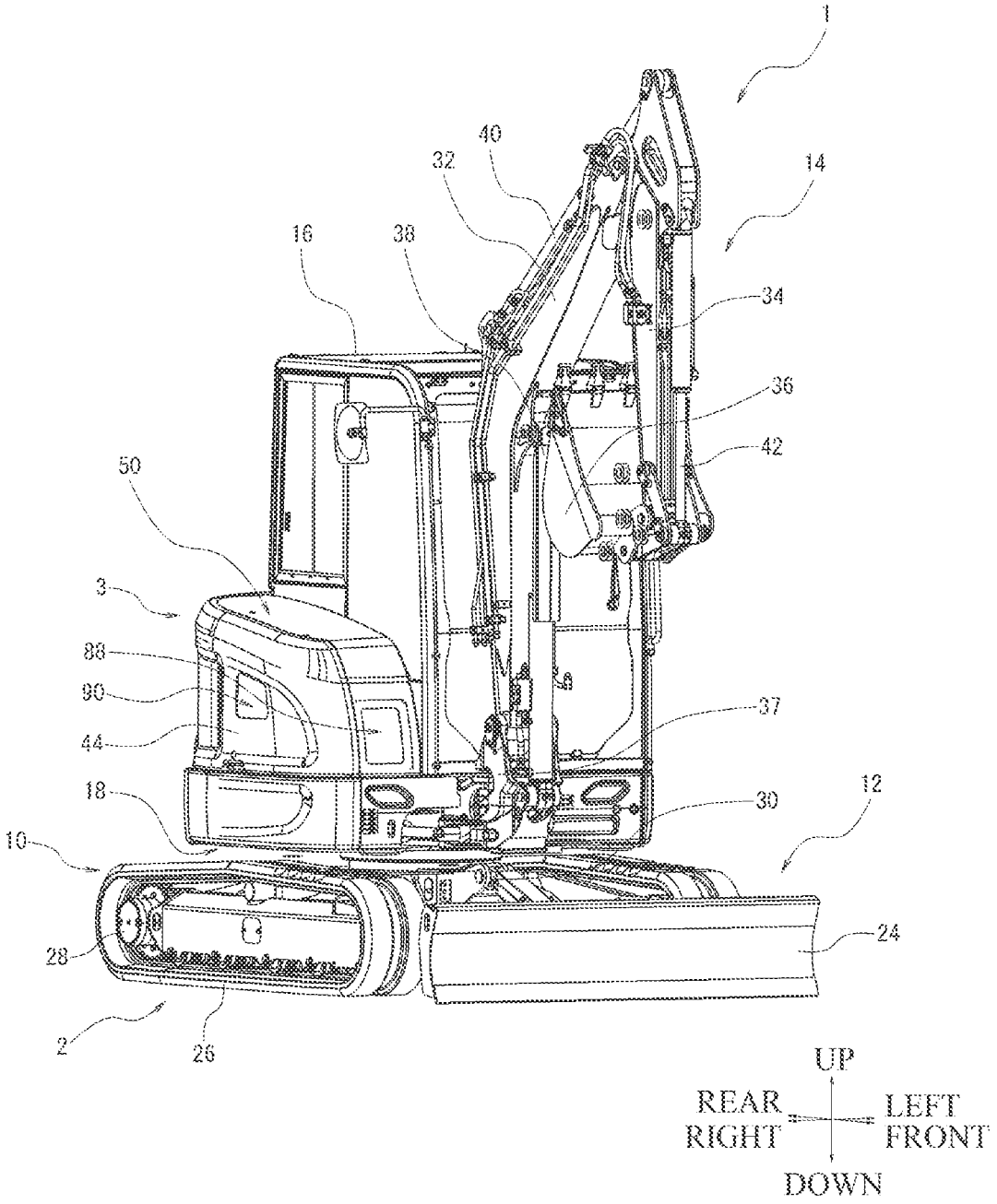
FIG. 2 is a perspective view of the working vehicle illustrated in FIG. 1 from a different direction.

Embodiments of the present invention will be described hereinafter in detail with reference to the drawings. FIGS. 1 and 2 are schematic diagrams (a perspective view from upper rear left and a perspective view from upper right front) illustrating an example of a working vehicle 1 according to an embodiment of the present invention. For the sake of convenience of description, arrows may indicate up and down, front and back, and left and right directions in the drawings. In addition, members having the same function are denoted by the same reference sign and may not be repeatedly described in all the drawings for describing the embodiments.

A hydraulic excavator will be described as an example of the working vehicle 1 according to the present embodiment. However, the working vehicle 1 is not limited to the hydraulic excavator.

As illustrated in FIGS. 1 and 2, the working vehicle 1 includes, as a vehicle body, a lower body 2 and an upper body 3 provided on the lower body 2. The upper body 3 is slewed by an electric slew motor (not illustrated). It is noted that the lower body 2 and the upper body 3 of the working vehicle 1 may be configured as one piece.

The lower body 2 includes a travel unit 10 that travels. The lower body 2 includes a pair of left and right crawlers (tracks) 26 as an example of the travel unit 10. However, the travel unit 10 is not limited to the crawlers 26. As another example, the working vehicle 1 may include tires (not illustrated) instead of the crawlers 26. The crawlers 26 are each driven (to travel) by a hydraulic travel motors 28.

The working vehicle 1 includes working units 12 and 14 mounted to the lower body 2 or the upper body 3 and worked by a hydraulic pressure (hydraulic oil at a predetermined pressure).

The working vehicle 1 includes a blade 24 as an example of the working unit 12. The blade 24 is mounted to the lower body 2 in such a way as to be able to swing upward and downward (including forward and backward components). The blade 24 is driven by a hydraulic cylinder (blade cylinder) 30. However, the working unit 12 is not limited to the above configurations.

The working vehicle 1 includes a boom 32, an arm 34, and an attachment (a bucket in the present embodiment) 36 as an example of the working unit 14. However, the attachment 36 is not limited to the bucket. The boom 32 is mounted to the upper body 3 in such a way as to be able to swing upward and downward (including forward and backward components). In the present embodiment, a boom bracket 37 is provided between the upper body 3 and the boom 32. The boom bracket 37 enables the boom 32 to swing to left and right (including forward and backward components) in relation to the upper body 3. It is noted that the boom bracket 37 may be omitted. The arm 34 is mounted to the boom 32 in such a way as to be able to swing upward and downward (including forward and backward components). The attachment 36 is mounted to the arm 34 in such a way as to be able to swing upward and downward (including forward and backward components). The boom 32 is driven by a hydraulic cylinder (boom cylinder) 38. The arm 34 is driven by a hydraulic cylinder (arm cylinder) 40. The attachment 36 is driven by a hydraulic cylinder (bucket cylinder) 42. However, the working unit 14 is not limited to the above configurations.

A driving mechanism for driving the hydraulic travel motors 28 and the hydraulic cylinders is configured from hydraulic pumps (to be described later in detail) driven by a drive source, a control valve (not illustrated), and the like. The control valve is actuated by an operator operating the operating units to exercise control to supply hydraulic oil at a predetermined pressure delivered from the hydraulic pumps to the hydraulic travel motors 28 and the hydraulic cylinders. This allows for the travel unit 10 to travel and for the working units 12 and 14 to work. In the present embodiment, the working vehicle 1 includes electric motors (to be described later in detail) as the drive source.

The working vehicle 1 also includes an on-board charger 94 that supplies electric power to the electric motors. The electric power output from the on-board charger 94 is supplied to the electric motors via a battery pack 96 and inverters (to be described later in detail). The battery pack 96 includes a first rechargeable battery (e.g., lithium-ion rechargeable battery) that stores the supplied electric power, a control section controlling the supply of the electric power to the electric motors and the rechargeable battery (first rechargeable battery), and the like (all of which are not illustrated). A second rechargeable battery (e.g., lead-acid rechargeable battery) and switches (controllers) are connected to the battery pack 96 (all of which are not illustrated).

Configurations of the upper body 3 will next be described in detail. The upper body 3 includes a main body frame 18 that is provided in a lower portion and that serves as both a reinforcement member and a support member for the on-board devices. The main body frame 18 is formed from plates, beams, and the like worked into predetermined shapes and welded integrally. The upper body 3 includes a cab 16 provided in a front left portion and in which operating units for an operator to operate traveling and working are provided. In the present embodiment, an air conditioner for air-conditioning an interior of the cab 16 is provided.

The upper body 3 includes a counterweight 20 that is provided in a rear portion and that maintains a balance during slewing. The upper body 3 includes a hydraulic oil tank 22 provided in a right central portion and storing hydraulic oil. The upper body 3 includes exterior covers (a right side cover 44, a left side cover 46, and a battery cover 48) covering devices on board the main body frame 18. The cab 16, the counterweight 20, and the hydraulic oil tank 22 are mounted to the main body frame 18. The exterior covers are mounted to a floor frame (not illustrated).

Figure 4:
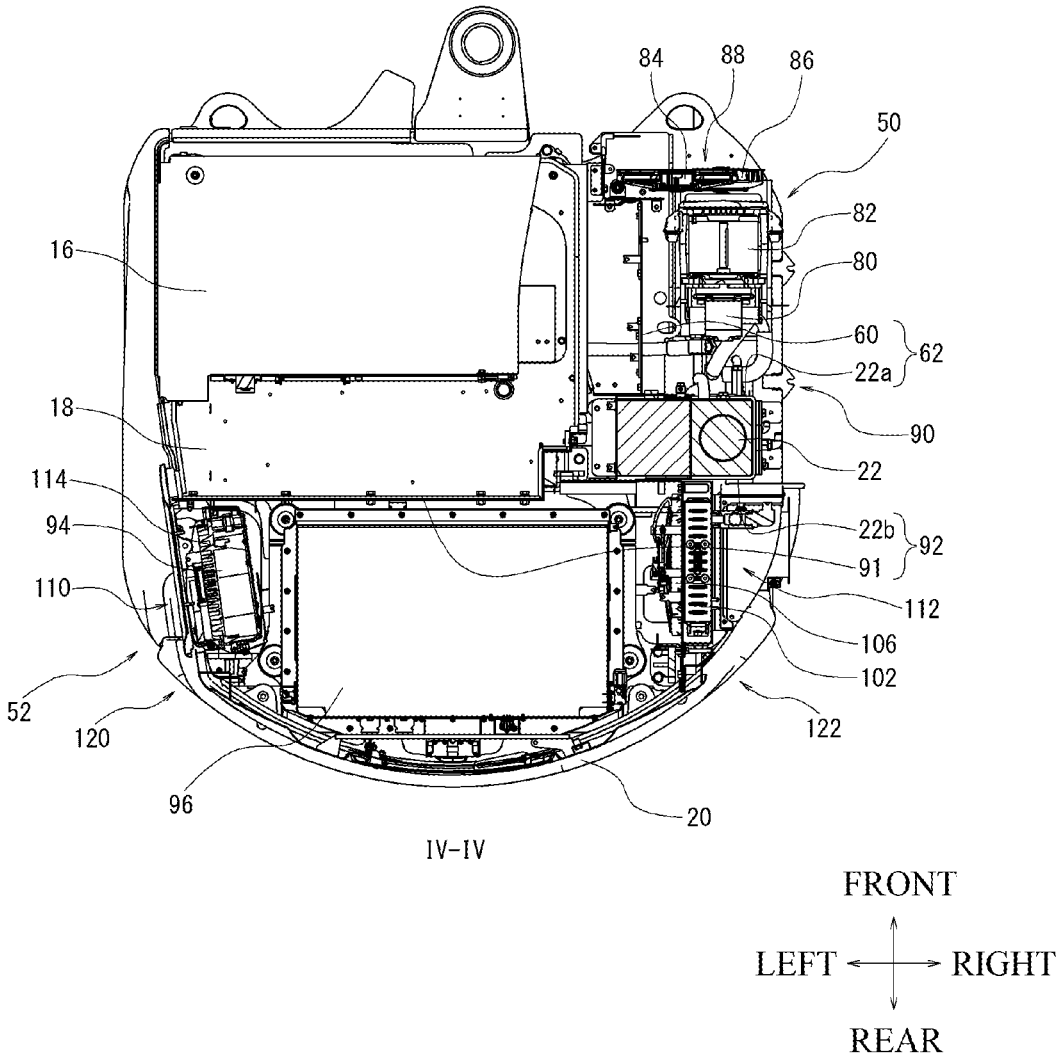
FIG. 4 is a cross-sectional view of a IV-IV cross-section illustrated in FIG. 3A.

As illustrated in FIG. 4, the upper body 3 includes a first device chamber 50 in a front portion (to the right of the cab 16 and in front of the hydraulic oil tank 22). The first device chamber 50 is partitioned from the surroundings inside the upper body 3 by a first partition 62 constituted from a partition plate 60 built on the main body frame 18 and a front surface 22*a* of the hydraulic oil tank 22. An upper portion of the first device chamber 50 is covered with the right side cover 44. The upper body 3 includes a second device chamber 52 in a rear portion (in the rear of the cab 16 and the hydraulic oil tank 22). The second device chamber 52 is partitioned from the surroundings inside the upper body 3 by a second partition 92 constituted from a partition plate 91 built on the main body frame 18 and a rear surface 22*b* of the hydraulic oil tank 22. An upper portion of the second device chamber 52 is covered with the left side cover 46 and the battery cover 48.

Figure 5:
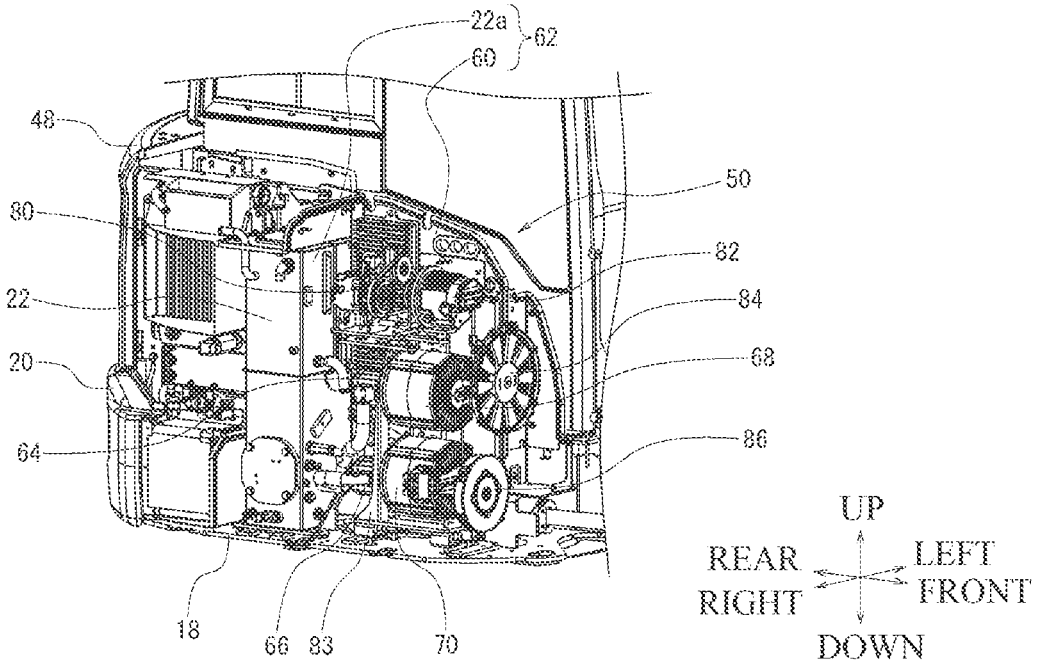
FIG. 5 is a perspective view illustrating an interior of a first device chamber.
Figure 6:
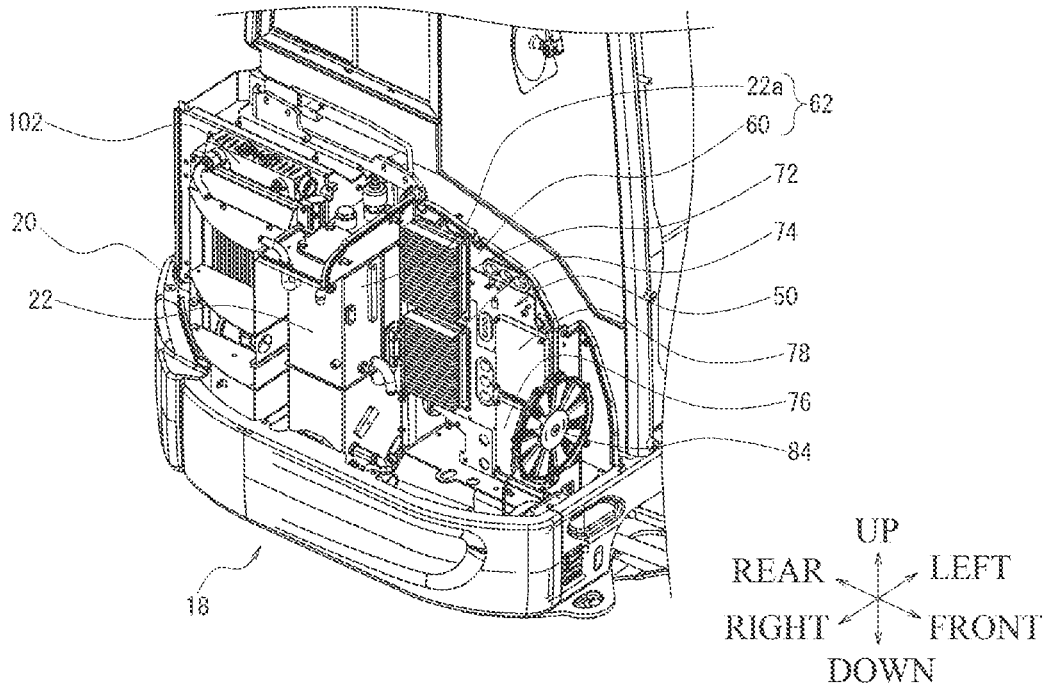
FIG. 6 is a perspective view illustrating a first partition.

First, the first device chamber 50 will be described (refer to FIGS. 5 and 6). In the first device chamber 50, devices that generate heat when the working vehicle 1 operates and that become relatively high temperature or have relatively high heat resistance (hereinafter, "in a high proper temperature zone") are provided. Specifically, the first device chamber 50 includes a first hydraulic pump 64 and a second hydraulic pump 66. The first device chamber 50 includes a first electric motor 68 and a second electric motor 70. The first device chamber 50 includes a first inverter 72, a second inverter 74, a third inverter 76, and a fourth inverter 78. The first device chamber 50 includes an air conditioner compressor 80 and a mini electric motor 82.

The first electric motor 68 and the second electric motor 70 are mounted to be aligned upward and downward on an electric motor bracket 83. The first electric motor 68 drives the first hydraulic pump 64. The second electric motor 70 drives the second hydraulic pump 66.

The first hydraulic pump 64 is mounted to a rear portion of the first electric motor 68. The second hydraulic pump 66 is mounted to a rear portion of the second electric motor 70. The first hydraulic pump 64 and the second hydraulic pump 66 draw in the hydraulic oil stored in the hydraulic oil tank 22 and supply (pump) the hydraulic oil to the travel unit 10 or the working units 12 and 14.

The first inverter 72, the second inverter 74, the third inverter 76, and the fourth inverter 78 are mounted to the partition plate 60. The first inverter 72 controls a driving voltage of the first electric motor 68. The second inverter 74 controls a driving voltage of the second electric motor 70. The third inverter 76 controls a driving voltage of the electric slew motor. The fourth inverter 78 controls a driving voltage of the mini electric motor 82.

The air conditioner compressor 80 is provided above the electric motor bracket 83.

The mini electric motor 82 is mounted to a front portion of the air conditioner compressor 80. The mini electric motor 82 drives the air conditioner compressor 80.

The first device chamber 50 has a first air inlet 88 in a front portion of the upper body 3 (right side cover 44). One or a plurality of first air inlets 88 are provided. The first device chamber 50 has a first air outlet 90 in a right side portion of the upper body 3 (right side cover 44). One or a plurality of first air outlets 90 are provided.

The first device chamber 50 includes cooling fans 84 and 86. The cooling fans 84 and 86 are provided to be aligned upward and downward in the front portion (in front of the first air inlet 88). The cooling fan 84 is a normally driven main fan. The cooling fan 86 is a sub-fan operating in an auxiliary manner depending on an operational status of the working vehicle 1. The cooling fan 86 may be omitted.

Cooling air (outside air) is taken in the first device chamber 50 via the first air inlet 88 by rotating the cooling fans 84 and 86. The cooling air taken in flows in the first device chamber 50 along the first partition 62 and cools the devices in the first device chamber 50. The cooling air heated up after absorbing heat from the devices is discharged outside the first device chamber 50 via the first air outlet 90.

Figure 3A:
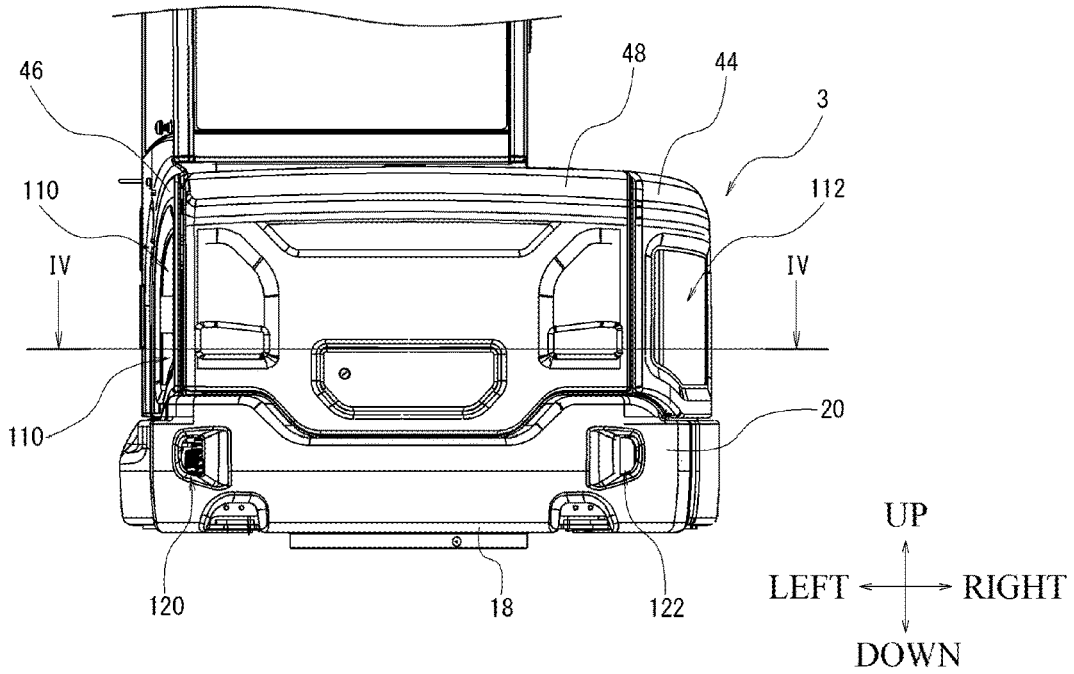
FIG. 3A is a back view of an upper body of the working vehicle.
Figure 3B:
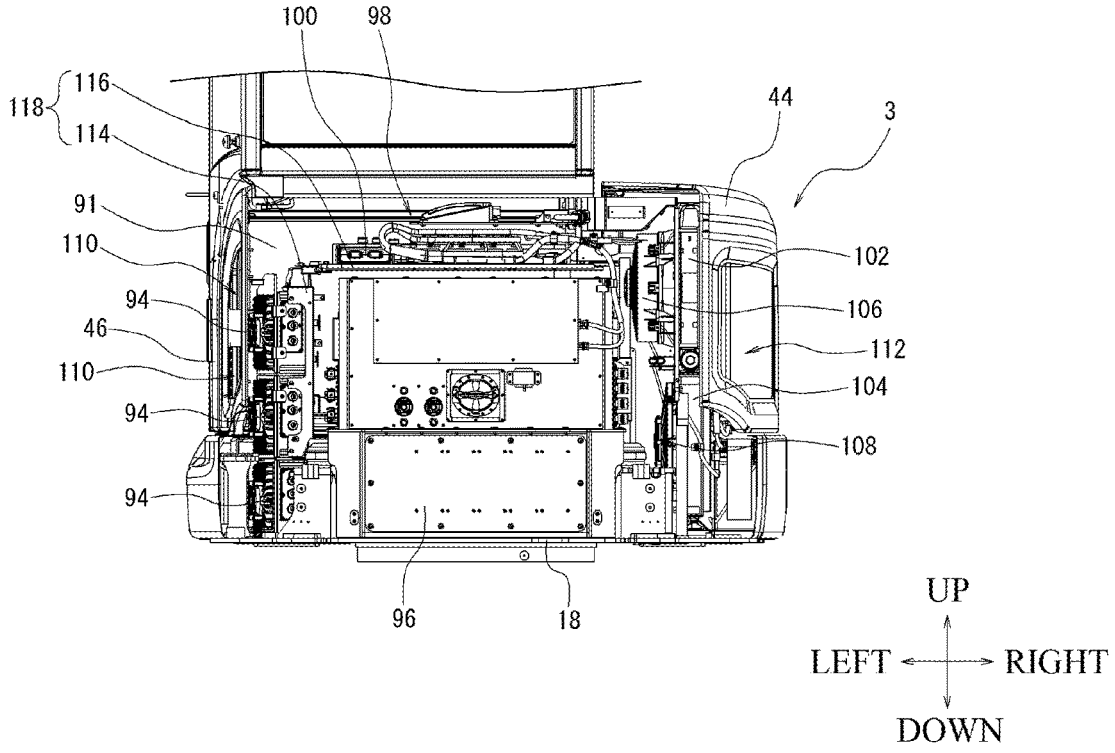
FIG. 3B is a back view of the upper body of the working vehicle with a counterweight and a battery cover not illustrated.
Figure 7:
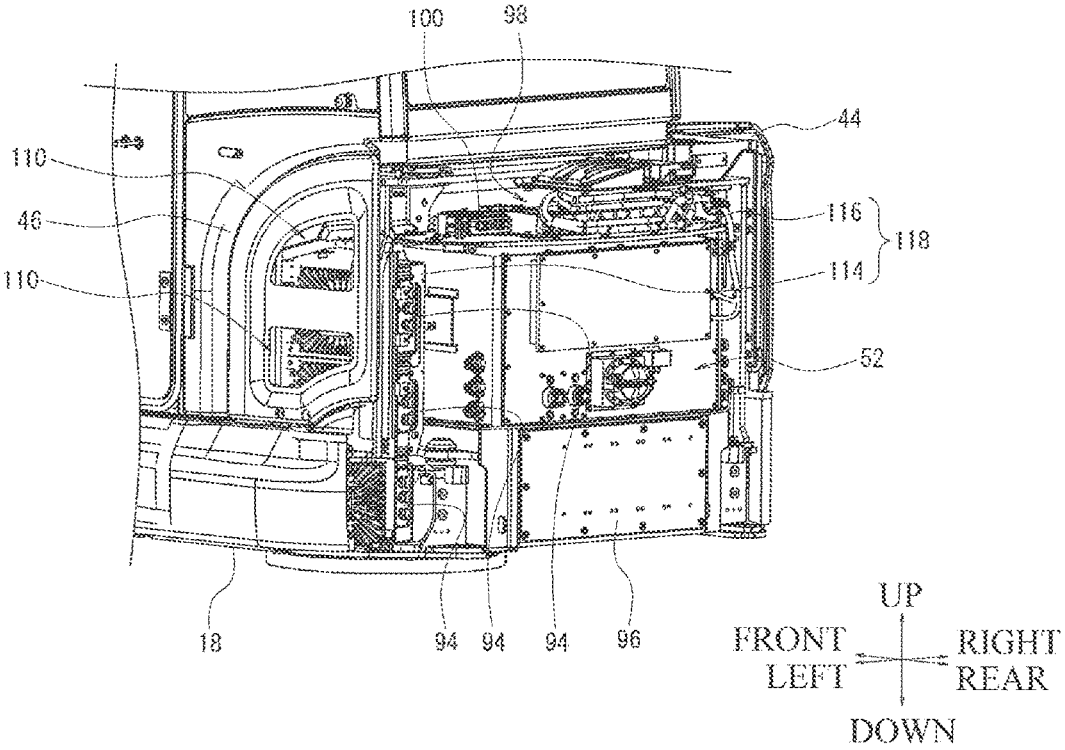
FIG. 7 is a perspective view illustrating an interior of a second device chamber.
Figure 8:
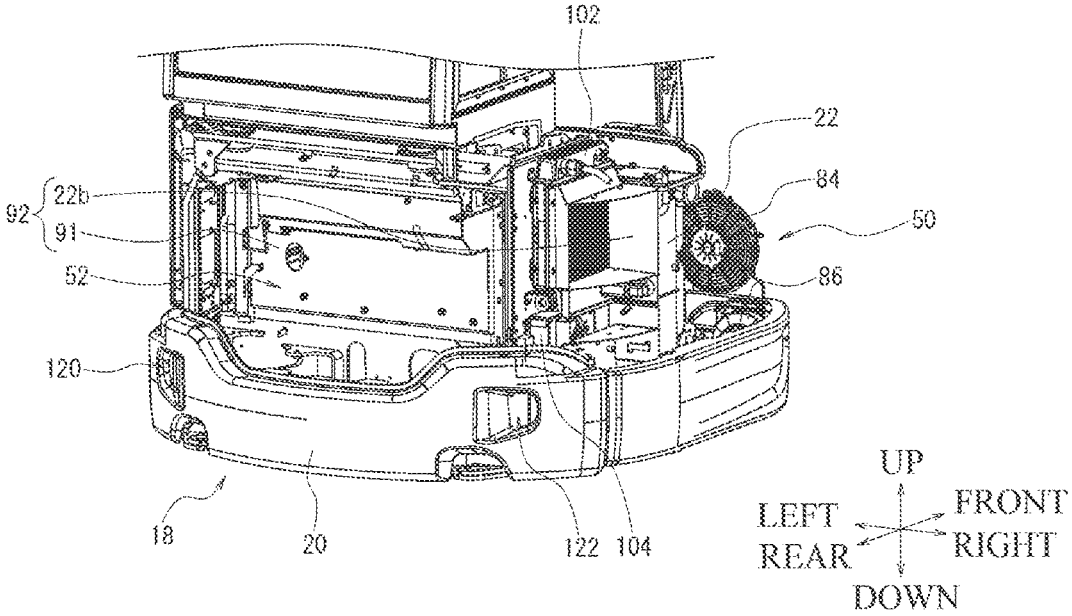
FIG. 8 is a perspective view illustrating a second partition.

Next, the second device chamber 52 will be described (refer to FIGS. 3B, 7, and 8). In the second device chamber 52, devices that generate heat when the working vehicle 1 operates and that do not become relatively high temperature or have relatively low heat resistance (hereinafter, "in a low proper temperature zone") are provided. Specifically, the second device chamber 52 includes the on-board charger 94, the battery pack 96, a converter 98, and a controller 100.

The second device chamber 52 also includes an oil cooler 102 and an air conditioner condenser 104.

The on-board charger 94 is provided in a left portion of the second device chamber 52 (at a position closer to a second air inlet 110 (to be described later in detail)). The on-board charger 94 supplies electric power for driving the electric motors 68, 70, and the like.

The battery pack 96 is provided in a central portion of the second device chamber 52 (at a position farther from the second air inlet 110). The battery pack 96 is partitioned from the on-board charger 94, the converter 98, and the controller 100 inside the second device chamber 52 by a third partition 118 constructed from partition plates 114 and 116. The partition plate 114 is provided between the on-board charger 94 and the battery pack 96. The partition plate 116 is provided above the battery pack 96. The battery pack 96 stores electric power supplied from the on-board charger 94.

The converter 98 is mounted on the partition plate 116. The converter 98 converts an output voltage of the battery pack 96.

The controller 100 is located to the left of the converter 98 and mounted on the partition plate 116. The controller 100 exercises a plurality of controls, including controls over the operation of the working vehicle 1 (such as slewing by the electric slew motor, traveling by the travel unit 10, working by the working units 12, 14, and running of the air conditioner for air-conditioning the interior) and controls over the supply of the electric power to the on-board devices. It is noted that these controls may be performed by a plurality of controllers (not illustrated).

The oil cooler 102 is provided in a right portion (at a position proximate to a second air outlet 112). The oil cooler 102 cools the hydraulic oil returned from the travel unit 10 and the working units 12 and 14.

The air conditioner condenser 104 is provided below the oil cooler 102.

The second device chamber 52 has the second air inlet 110 in a left side portion of the upper body 3 (left side cover 46). One or a plurality of second air inlets 110 are provided. The second device chamber 52 has the second air outlet 112 in a right side portion of the upper body 3 (right side cover 44) (at a position rearward of the first air outlet 90). One or a plurality of second air outlets 112 are provided.

The second device chamber 52 includes cooling fans 106 and 108. The cooling fan 106 is mounted to the left of the oil cooler 102. The cooling fan 108 is mounted to the left of the air conditioner condenser 104. It is noted that the cooling fan 108 is a cooling fan that mainly cools the air conditioner condenser 104.

Cooling air (outside air) is taken in the second device chamber 52 via the second air inlet 110 by rotating the cooling fans 106 and 108. The cooling air taken in flows in the second device chamber 52 along the second partition 92 and the third partition 118 and cools the devices in the second device chamber 52. Specifically, the cooling air cools the on-board charger 94 first, the controller 100 next, the converter 98 next, and then the oil cooler 102 and the air conditioner condenser 104. The cooling air heated up after absorbing heat from the devices is discharged outside the second device chamber 52 via the second air outlet 112.

Here, the heated cooling air does not flow to the battery pack 96 since the battery pack 96 is partitioned (shielded) by the third partition 118. This can inhibit a temperature rise of the battery pack 96, which is particularly vulnerable to heat.

A rear portion of the battery pack 96 is covered with the counterweight 20. The counterweight 20 has a third air inlet 120 in a left portion (at a position closer to the second air inlet 110). The counterweight 20 has a fourth air inlet 122 in a right portion (at a position closer to the second air outlet 112).

The battery pack 96 is cooled by cooling air taken in via the third air inlet 120. The cooling air taken in resolves the stagnation of heat generated from the battery pack 96. This can prevent heat damage to the battery pack 96.

The oil cooler 102 and the air conditioner condenser 104 are cooled by not only the cooling air taken in via the second air inlet 110 but also the cooling air taken in via the third air inlet 120 and the fourth air inlet 122. The cooling air taken in is discharged outside the second device chamber 52 via the second air outlet 112. This can efficiently cool the oil cooler 102 and the air conditioner condenser 104.

As described so far, the working vehicle 1 according to the present embodiment includes: the first device chamber 50 provided in the front portion of the upper body 3; and the second device chamber 52 provided in the rear portion of the upper body 3, the devices in the high proper temperature zone are provided in the first device chamber 50, the devices in the low proper temperature zone are provided in the second device chamber 52, and the first device chamber 50 and the second device chamber 52 are cooled separately by the cooling fan 84 (86) and the cooling fan 106 (108), respectively. This can reduce ranges of the proper temperature zones of the devices provided in the device chambers 50 and 52, facilitating the management of the reference temperatures (that is, cooling fan control). Therefore, improved cooling efficiency, reduced power consumption, and suppressed noise caused by the cooling fans can be achieved. Furthermore, isolating the device chambers 50 and 52 by the partitions 62 and 92 can prevent heat generated in the first device chamber 50 from being transferred to the second device chamber 52. Therefore, it is possible to prevent heat damage to devices with low heat resistance.

Moreover, the working vehicle 1 according to the present embodiment has the first air inlet 88 in the front portion of the upper body 3 and the second air inlet 110 in the left side portion of the upper body 3. The working vehicle 1 has the first air outlet 90 and the second air outlet 112 in the right side portion of the upper body 3. That is, the air inlets 88 and 110 are provided facing the vehicle body surface where the air outlets 90 and 112 are provided or are provided on the other side surface of the vehicle body surface; therefore, fresh cooling air (that is, cooling air at outside air temperature) can always be taken in the first device chamber 50 and the second device chamber 52. Therefore, the cooling efficiency can be improved.

As described so far, according to the present invention, the working vehicle capable of realizing improved cooling efficiency can be provided.

While the working vehicle mounting the two hydraulic pumps that configure the driving mechanism has been described as an example of the working vehicle 1, the working vehicle 1 may mount one or three or more hydraulic pumps depending on configurations, loads, and the like of the working units 12 and 14 and the travel unit 10. Furthermore, the number of electric motors that configure the drive source may be changed as appropriate depending on the number, rated output power, and the like of the hydraulic pumps.

While the working vehicle mounting the air conditioner in the cab 16 for air-conditioning the interior of the cab 16 has been described as an example of the working vehicle 1, the working vehicle 1 may be configured without the air conditioner. In that case, the air conditioner compressor 80, the mini electric motor 82, the fourth inverter 78, the air conditioner condenser 104, and the cooling fan 108 are omitted.

The present invention is not limited to the above example (hydraulic excavator). The present invention is similarly applicable to other working vehicles (e.g., a track loader and a tracked dumper).

What is claimed is:

1. A working vehicle having:

a vehicle body;

a travel unit;

a working unit working by a hydraulic pressure; and an electric motor that serves as a drive source for the travel unit or the working unit, wherein the working vehicle comprises:

a first device chamber provided in a front portion of the vehicle body;

a second device chamber provided in a rear portion of the vehicle body;

a first partition that partitions the first device chamber from surroundings inside the vehicle body; and a second partition that partitions the second device chamber from the surroundings inside the vehicle body, wherein the first device chamber comprises devices that generate heat and that become relatively high temperature or have relatively high heat resistance, the device including:

a hydraulic pump that supplies hydraulic oil to the travel unit or the working unit;

an electric motor that drives the hydraulic pump; and an inverter that controls a driving voltage of the electric motor, wherein the second device chamber comprises devices that generate heat and that do not become relatively high temperature or have relatively low heat resistance, the device including:

an on-board charger that supplies electric power for driving the electric motor;

a battery pack having a rechargeable battery that stores the electric power supplied from the on-board charger;

a converter that converts an output voltage of the battery pack; and a controller, and wherein the first device chamber and the second device chamber are separately cooled by different fans, respectively, wherein the first device chamber has a first air inlet in the front portion of the vehicle body and a first air outlet in one side portion of the vehicle body.

2. The working vehicle according to claim 1, wherein the second device chamber has a second air inlet in the other side portion of the vehicle body and a second air outlet in the one side portion of the vehicle body, and comprises a third partition that partitions the on-board charger disposed at a position closer to the second air inlet from the battery pack disposed at a position farther from the second air inlet.

3. The working vehicle according to claim 2, wherein the vehicle body comprises a counterweight that is provided in the rear portion and that maintains a balance during slewing, wherein the counterweight has a third air inlet at a position closer to the second air inlet, and wherein the battery pack is cooled by outside air taken in mainly from the third air inlet.

4. The working vehicle according to claim 3, wherein the second device chamber comprises an oil cooler proximate to the second air outlet, wherein the counterweight has a fourth air inlet at a position closer to the second air outlet, and wherein the oil cooler is cooled by the outside air taken in from the second air inlet, the third air inlet, and the fourth air inlet.

* * * * *